US005727540A

United States Patent [19]

Eberhardt

[11] Patent Number: 5,727,540

[45] Date of Patent: Mar. 17, 1998

[54] FIREPLACE HEAT EXCHANGER

[76] Inventor: H. Alfred Eberhardt, Shipps Landing, Unit 1023, 1100 S. Collier Blvd., Marco Island, Fla. 33937

[21] Appl. No.: 734,367

[22] Filed: Oct. 16, 1996

Related U.S. Application Data

[63] Continuation-in-part of Ser. No. 384,832, Feb. 7, 1995, Pat. No. 5,572,986.

[51] Int. Cl.[6] ..... F23L 1/00

[52] U.S. Cl. ..... 126/515; 126/502; 126/522; 126/524; 165/DIG. 2; 237/51

[58] Field of Search ..... 126/515, 502, 126/522, 529, 524, 521; 165/DIG. 2; 237/51

[56] References Cited

U.S. PATENT DOCUMENTS 4,357,930 11/1982 Eberhardt ..... 126/515
5,572,986 11/1996 Eberhardt ..... 126/515

*Primary Examiner*—Larry Jones
*Attorney, Agent, or Firm*—John F. A. Earley; John F. A. Earley, III; Harding, Earley, Follmer & Frailey

[57] ABSTRACT

A system for heating the air in the room containing a fireplace includes a heat exchanger mounted at the top portion of the combustion chamber of the fireplace to extend across the chimney flue opening and a fan for circulating room air through the heat exchanger in heat exchange relationship with the combustion gases passing from the combustion chamber in a vortex flow through a heat exchange passage in the heat exchanger to the chimney flue opening. There are preferably provided a pair of the heat exchangers mounted in side-by-side relationship to conform with the rectangular shape of the plan view of the fireplace.

8 Claims, 11 Drawing Sheets

FIREPLACE HEAT EXCHANGER

This is a continuation-in-part of application(s) Ser. No. 08/384,832 filed on Feb. 2, 1995, now U.S. Pat. No. 5,572,986

BACKGROUND AND SUMMARY OF THE INVENTION

Conventional fireplaces are inefficient sources of heat for the room in which they are located primarily because the fire draws air from the room and large amounts of outside air into the house to meet the combustion requirements of the fire. This causes drafts of cold air along the floor of the room and the cooling of the house.

In my U.S. Pat. No. 4,357,930, there is disclosed a fireplace heating system for heating the room air by the use of a compact heat exchanger mounted at the top portion of the combustion chamber of the fireplace to extend across the location where the chimney flue connects with the top portion of the combustion chamber. A fan is provided for circulating room air through the heat exchanger in a manner so that the hot combustion gases heat up the room air being circulated therethrough.

In accordance with the present invention, there is provided an improved heat exchanger device that increases the efficiency and performance of fireplace heating systems. The heat exchanger device in accordance with the invention is particularly adaptable to homes heated by heat pumps. Heat pumps are relatively inefficient at low outside temperatures (below 40° F.) and are normally supplemented with electric resistance heating, especially in the northern regions of the United States. Electric resistance heating is very expensive to operate. By the use of the heat exchanger device in accordance with the invention, it is possible to drastically reduce the "electric demand" on wiring and power plants during critical winter time "cold snaps".

The basic purpose of the device in accordance with the present invention is to extract substantial heat energy from the fire in the fireplace during these periods of very low outside temperatures by the use of a novel heat exchanger. This device, for instance, may be used in conjunction with a ceramic gas log burning bottled propane in a conventional fireplace, this type of burner being well known in the art. Normally, these gas logs are added to existing fireplaces for the convenience and aesthetic visual pleasure of the gas flame.

By using the novel heat exchanger device in accordance with the invention in a heating system as described hereinafter, it is possible to make the gas log burner a practical source of environmentally clean thermal energy, especially in cold winter climates. Moreover, the novel arrangement in accordance with the invention may also be applied to the more conventional wood-burning fireplace. As will be described hereafter, one of the features of the heat exchanger device in accordance with the invention is that it is readily adaptable to existing fireplaces and can even utilize existing fireplace screens or covers.

The optimum employment of the heat exchanger in accordance with the invention is in a heating system that utilizes outside air for combustion, a glass cover for the fireplace opening, and, preferably, a means for distributing the heat coming from the heat exchanger to the entire home or other structure. If a heat pump or central air conditioning system has been installed in the home whereat the heating system is used, it would be desirable to have the heat exchanger device function as a supplemental heat source, using a booster fan installed in the return duct of the room where the fireplace is located forcing the warm air from the fire place into the plenum chamber and subsequently circulating it through the entire house.

While the description of the invention illustrates that the invention can be applied to an existing conventional fireplace with its conventional glass screen or cover, it will be noted that the invention can also be applied to new construction, which might utilize a single heat exchanger (instead of the pair of heat exchangers described) in a modern type of "free-standing" fireplace with a glass enclosure on all four sides.

Another feature of the invention is that all of the components of the heat exchanger device are designed and arranged so that they can be manufactured and assembled economically and so as to result in a viable commercial product pleasing in appearance and economical to operate.

Briefly stated, a fireplace heating system in accordance with the invention includes a heat exchanger means mounted at the top portion of the combustion chamber to extend across a location where the chimney flue connects with the top portion of the combustion chamber, and fan means for circulating room air through the heat exchanger. The heat exchanger comprises means defining a heat exchange passage for the flow of room air and means for defining a second heat exchange passage for the flow of combustion gases in a vortex flow from the combustion chamber to the chimney flue, the heat exchange passages being arranged in heat exchange relationship so that the hot combustion gases heat up the room air being circulated through the heat exchanger by the fan means. In accordance with a preferred embodiment, there are provided two of the novel heat exchangers which are arranged in side-by-side relationship to conform with the rectangular shape of the plan view of a traditional fireplace. In addition, the device in accordance with the invention is designed to be adjustable and thus readily adaptable to retrofitting various sizes and shapes of existing fireplaces.

An alternative preferred embodiment is provided which is easier to manufacture. This alternative preferred embodiment works in a manner similar to the first preferred embodiment by converting the thermal energy in a wood fire or gas log fireplace in a highly efficient manner to warm the room air circulating through the heat exchanger assembly and through the various chambers and passageways of the heat exchanger assembly.

To obtain this high efficiency, I place a heat exchanger between the heat source burning flame, and the exhaust gas exit, the chimney. The heat exchange assembly is designed to extract the maximum amount of heat by delaying the removal of the exhaust gases, and by causing the hot exhaust gases to dwell in the region of the heat exchanger, a region of high heat conductivity, while maintaining high heating gas velocity for good heat exchanging. This is accomplished through the novel use of an exhaust gas "spin chamber". As in my first preferred embodiment the lighter hotter spinning exhaust gases tend to spin on the inside of the "spin chamber", contacting the aluminum heat exchanger wall, while the denser cooler gases centrifuge to the outer steel cylinder wall of the "spin chamber". A difference between this second preferred embodiment and the first preferred embodiment, is that the second preferred embodiment is simpler and less expensive to construct and assemble.

DETAILED DESCRIPTION OF THE PREFERRED EMBODIMENT

Figure 1:
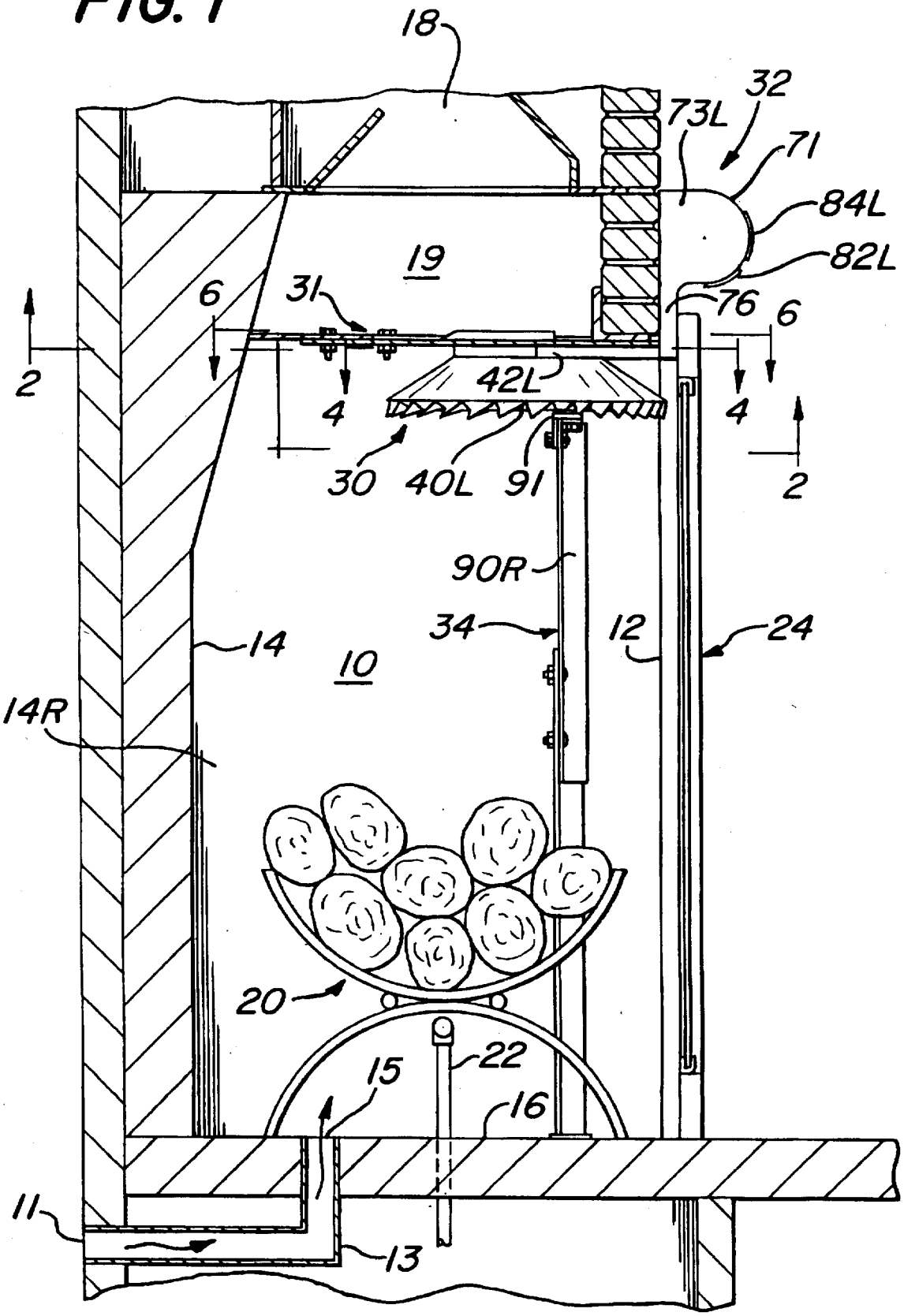
FIG. 1 is a vertical section through a fireplace provided with a room air heating system in accordance with the invention.
Figure 2:
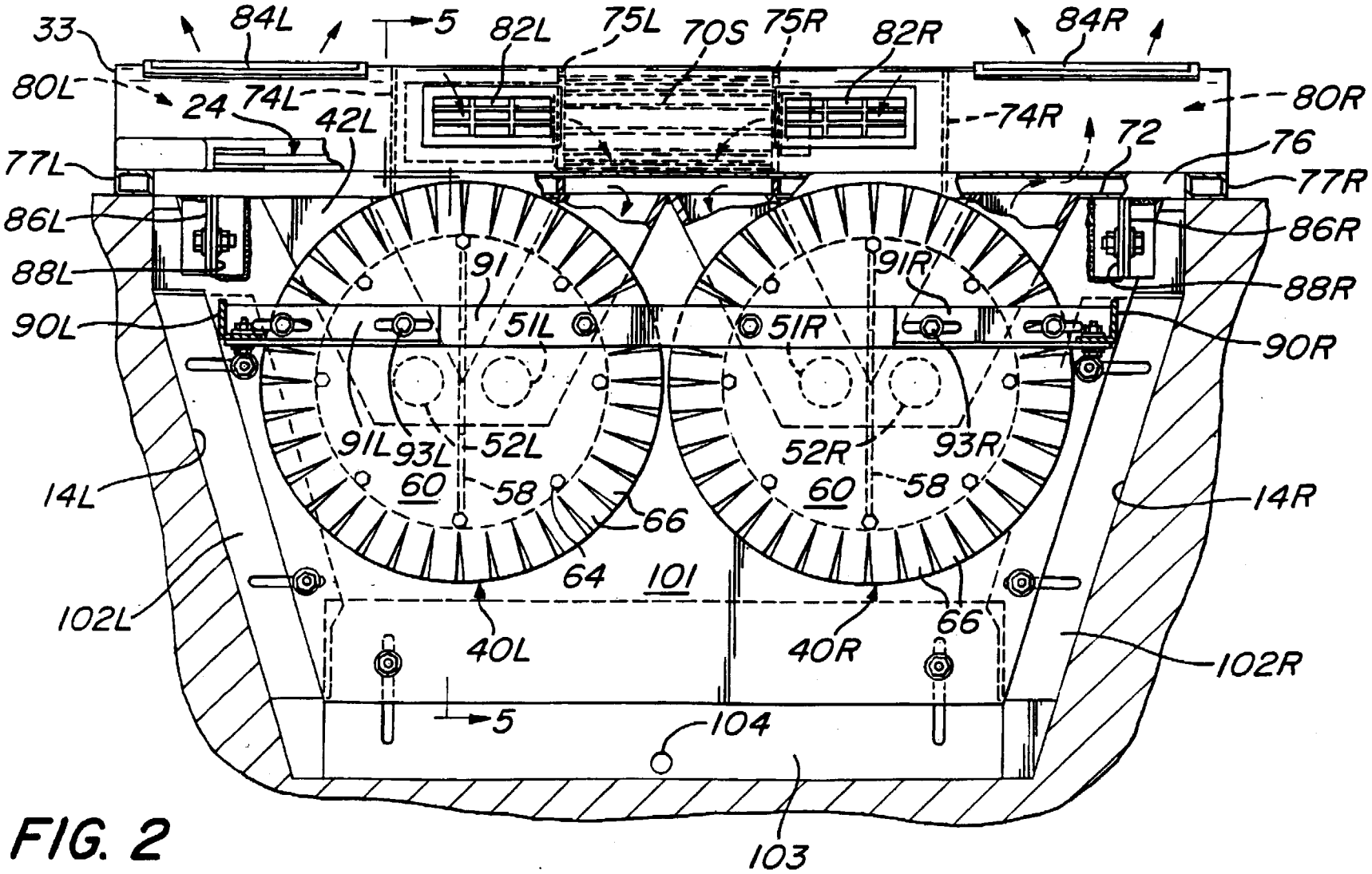
FIG. 2 is a sectional view taken on line 2—2 of FIG. 1.

In FIG. 1, there is shown a typical fireplace comprising a combustion chamber 10 having a front opening 12, a back wall 14, a pair of side walls 14L and 14R, a hearth 16, and a chimney flue 18 connected to the top portion of the combustion chamber 10 through a passage 19, which, typically, is damper controlled. The combustion gases are discharged through the chimney flue 18 by way of the passage 19. It is noted that the conventional ash pit opening provided in the hearth 16 and leading to an ash pit therebeneath is not necessary. Preferably, there is provided means for supplying relatively cold air to a hearth opening, and, to this end, there is provided an air intake vent 11 through which outside air may flow through a conduit 13 to a hearth opening 15 to supply combustion air for a burner located in the fireplace.

In FIG. 1, there is disclosed one suitable type of gas log burner 20 which is supplied with heating gas through a gas supply pipe 22. These gas log burners are well known in the art and various suitable types may be employed.

There is also provided a conventional fire screen assembly 24 which closes the front opening 12 and includes glass doors. The heating gases produced by the burner 20 will flow upwardly from the location of the burner combustion immediately above the hearth 16, said upwardly flowing gases being confined by the walls 14, 14L, and 14R of the fireplace and the glass screen 24.

Figure 3:
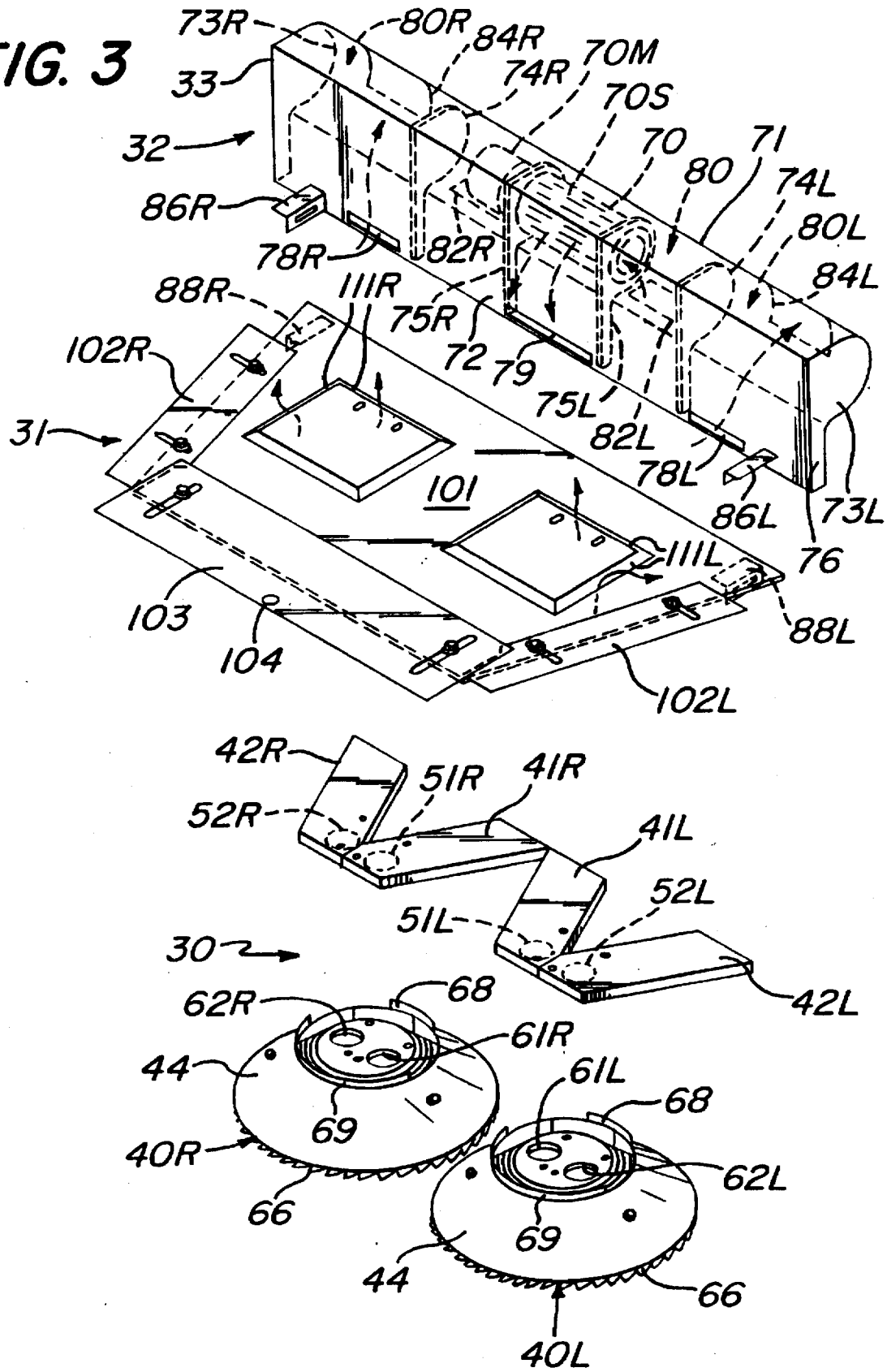
FIG. 3 is an exploded view showing various components of the heat exchanger device in perspective.

For ease of installation, the fireplace heat exchanger in accordance with the invention is made up of a plurality of subassemblies which will be described in detail hereafter. In FIG. 3, there is shown a subassembly 30 comprising a pair of heat exchangers 40R and 40L and their associated aluminum extrusions 41R, 42R, and 41L, 42L, respectively, which define conduits for the flow of the room air, an adjustable baffle plate 31 assembly, and a fan/duct housing assembly 32. There is also provided a subassembly 34 (FIG. 1) comprising an adjustable "goal post" type of support.

In accordance with the invention, there is provided a novel heat exchanger means comprising the pair of heat exchangers 40R and 40L and means for mounting the same at the top portion of combustion chamber 10 to extend across the location whereat the chimney flue 18 connects with the top portion of the combustion chamber 10. This is the hottest region of the combustion chamber 10 when the gas log burner 20 is in operation to heat the air within the combustion chamber 10.

The heat exchanger means comprises a pair of novel heat exchangers 40R and 40L arranged in side-by-side relation to conform with the rectangular shape of the plan view of the fireplace.

Each heat exchanger 40R and 40L is constructed and arranged to give the hot flue gases "dwell time" and "multiple passes" over a highly heat conductive member separating the flue gases from the circulating room air in order to extract as much thermal energy as possible in a relatively compact space. To this end, there are provided a pair of "spin" chambers each constructed and arranged to create a vortex flow of the combustion gases as they flow upwardly from the combustion chamber 10 and before they are drawn into the flue 18.

Each heat exchanger 40R and 40L is made of a material, such as aluminum, to provide a highly heat conductive arrangement and defines a first heat exchange passage for the flow of room air from the room into the top portion of the combustion chamber and back to the room and a second heat exchange passage for the flow of hot combustion gases upwardly from the combustion chamber 10 to the flue 18. The first and second heat exchange passages are arranged in heat exchange relationship so that the hot combustion gases passing from the combustion chamber 10 through the second heat exchange passage to chimney flue 18 heat up the room air being circulated through the top portion of the combustion chamber through the first heat exchange passage.

Heat exchangers 40R and 40L have essentially the same construction, wherefore, corresponding parts have been given the same reference numerals.

Figure 4:
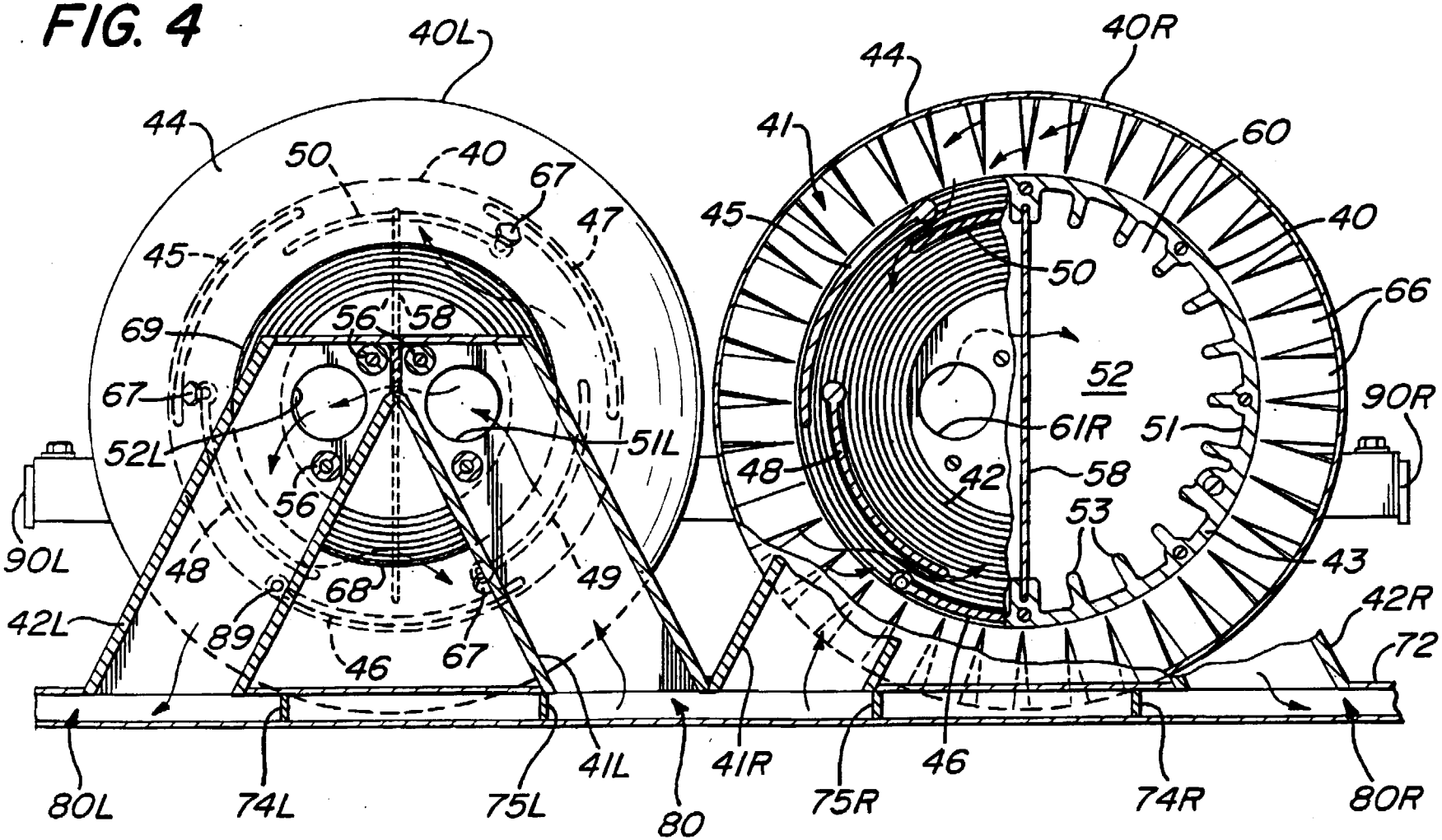
FIG. 4 is a sectional view taken generally on line 4—4 of FIG. 1.
Figures 5, 5A:
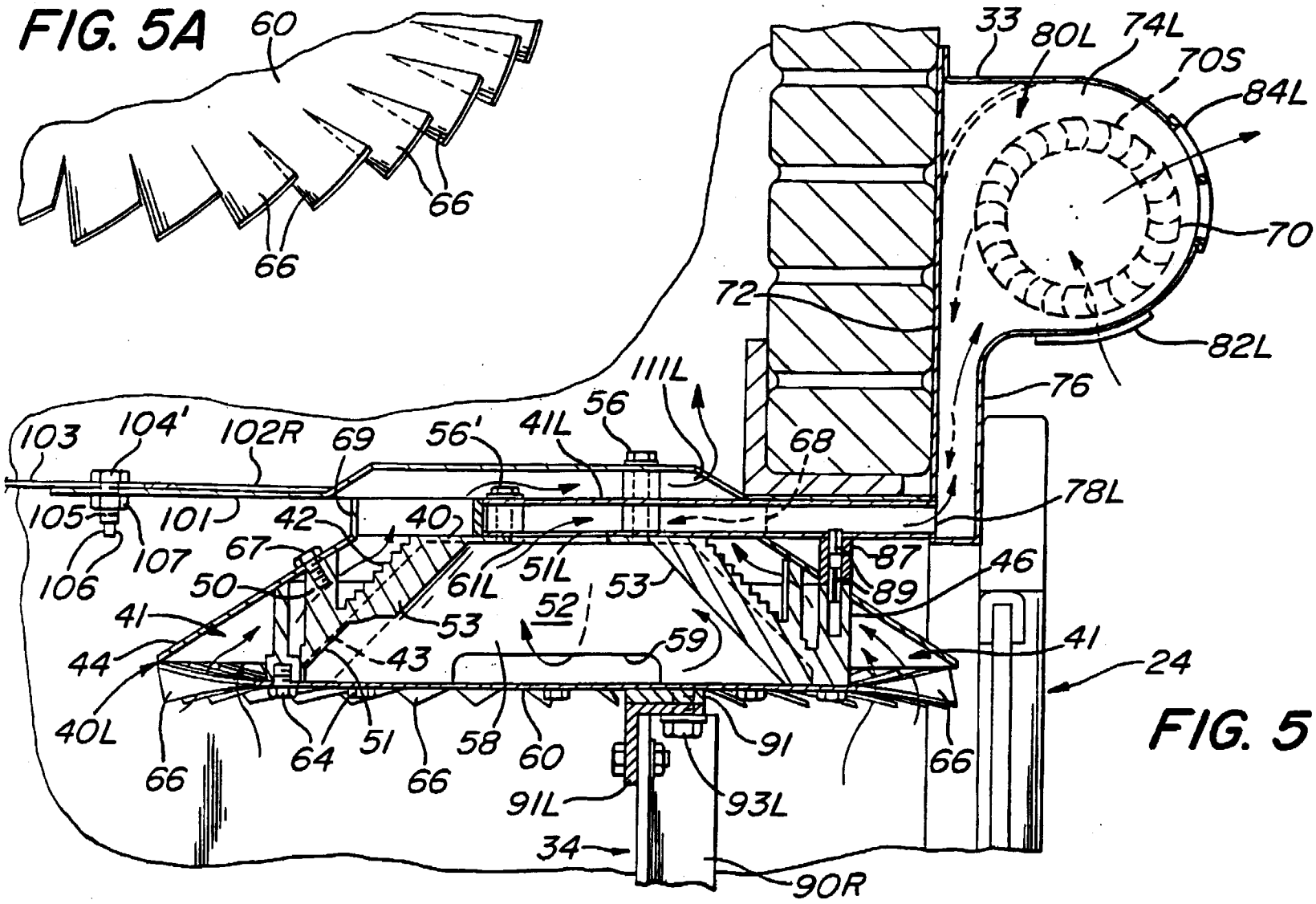
FIG. 5 is a side elevation, partly in section, of the heat exchanger shown in FIG. 1.
FIG. 5A is an enlarged fragmentary perspective view of a detail of the invention.

As best shown in FIGS. 4 and 5, each heat exchanger 40R and 40L comprises spin chamber 41 formed between the outer surface 42 of the conical wall 43 of an inverted bowl-shaped aluminum die casting 40 and a conical-shaped thin sheet steel segment 44. Thus, each spin chamber 41 has a generally annular configuration converging in the vertical direction (at an angle of about 45° ) to form a generally truncated conical configuration. The outer surface 42 of wall 43 contains a series of small (⅛ inch high) steps or concentric rings so as to increase the surface area and enhance the heat transfer of the spinning hot gases flowing through chamber 41. In addition, each heat exchanger 40R and 40L is provided with two groups of three, circumferentially equally spaced, arcuate guide vanes 45–50 formed in the aluminum casting 40 to project vertically upwardly from surface 42 of wall 43. Vanes 45–50 serve to increase the heat transfer area while at the same time are constructed and arranged to help maintain the circular motion of the spinning gases flowing through spin chamber 41.

As the hot gases circulate around and upwardly through a spin chamber 41, they serve to heat up wall 43 of the highly conductive aluminum casting 40, which wall 43 has its inner surface 51 in heat exchange relationship with a room air heat exchange chamber 52 formed in the interior portion of the bowl-shaped casting 40. Wall 42 is subjected to a cooling action by room air that is forcibly circulated through chamber 52 as will be described hereafter. The inner surface 51 of wall 43 is provided with a plurality of inwardly extending radial fins 53 which help to improve the heat transfer action by providing additional surface area in contact with the circulating room air.

The room air, which is driven by a fan to be described hereafter, is ducted to and from the room air chamber 52 of each heat exchanger 40R and 40L by means of the pairs of attached aluminum extrusions 41R,42R and 41L,42L, respectively, which provide conduits for the flow of the room air. The aluminum extrusions 41R,42R,41L,42L are highly thermally conductive and are rectangular-shaped (typically 1 inch by 3½ inches) aluminum extrusions, which may be provided with longitudinal ribs on the inner wall thereof to provide additional strength and heat transfer area. By reason of the construction and arrangement of the extrusions 41R,42R,41L, 42L, the room air is also heated as it passes therethrough and flows to and from each room air chamber 52 in a manner to be described hereafter.

Each of the extrusions 41R,42R,41L,42L is secured firmly onto the top wall of an associated one of the bowl castings 40 with a pair of heavy duty (⅜ inch) mounting drive screw assemblies 56 and 56", the mounting for one extrusion 41L being shown in detail in FIG. 5, wherein it is shown that since it is necessary for each screw assembly 56 and 56' to extend through the height of an extrusion, tubular spacers are used at each screw assembly 56 and 56' to prevent crushing of the thin wall aluminum extrusions.

Each extrusion 41R,42R,41L,42L is provided with a circular opening 51R,52R,51L,52L, respectively, (typically 2½ inch in diameter) in the bottom wall thereof. In the mounted condition of extrusions 41R,42R and 41L,42L on the top of the heat exchangers 40R and 40L, respectively, each of the openings 51R,52R,51L,52L is arranged to line up with a like-size opening 61R,62R,61L,62L, respectively, in the top of an associated bowl casting 40 to provide flow communication between the conduit defined by an extrusion and the inlet half of the circulating room air chamber 52 defined therebeneath in the associated heat exchanger 40R, 40L.

A vertical divider baffle 58 is arranged to divide the room air chamber 52 into an inlet half and an outlet half. Divider baffle 58 has a slot 59 in the bottom thereof to provide a flow passage for the flow of room air circulating from the inlet half to the outlet half of room air chamber 52. As the room air flows through the room air chamber 52 of each heat exchanger 40R and 40L, it flows downwardly through the inlet half of chamber 52 and is forced to flow against a circular bottom cover 60 closing the bottom portion of each heat exchanger 40R,40L, as best shown in FIG. 5. The bottom cover 60 is a thin (typically 0.025–0.030 inches thick) high-temperature stainless steel sheet which is bolted to the bottom of the bowl casting 40 with self-tapping screws 64 to thereby form a tight enclosure for the room air.

As is best shown in FIG. 5 and 5A, there are provided a plurality of guide vanes 66 in an annular peripheral portion extending around the outside of the bottom cover 60. Guide vanes 66 are formed by a series of cuts stamped in the peripheral portion of the cover 60 to extend radially inwardly from the periphery (typically about 1½ inches) and are twisted in forming dies so that each vane 66 will produce an angle of about 30° to the horizontal at its outer periphery. This angular construction produces guide vanes 66 which impart the initial spin to the hot gases as they are drawn through the spin chamber 41 of each heat exchanger 40R, 40L by the chimney's draft. Also, vanes 66 will become very hot during operation of each heat exchanger 40R,40L and will have a catalytic effect on any unburned combustible gases flowing past them. Vanes 66 are arranged to produce a swirling vortex flow of the combustion gases flowing upwardly through the heat exchange passage provided by spin chamber 41, said flow being in a counter-clockwise direction as viewed from the top of the heat exchangers 40R,40L (as shown by the arrows in FIG. 4). This spinning effect will produce a high velocity flow which ensures good conduction of heat into the aluminum casting 40 and will also provide a "dwell time" in the heat exchangers 40R,40L. In other words, each cubic foot of hot gas will have more and better exposure to the heat transfer walls of the heat exchangers 40R,40L. Additionally, the guide vanes 66 will provide good surface exposure on both sides thereof to pick up heat from these hot gases and conduct it into wall 43 and subsequently fins 53.

The rising, spinning hot combustion gases are kept in close proximity to the outer surface 42 of conical wall 43 of each heat exchanger 40R,40L as said gases flow through a spin chamber 41 because they are contained by conical segment 44. Each conical segment 44 is held in place by three self tapping screws 67 fastened to the inner set of cast vertical guide vanes 48,49,50 as shown in FIG. 4.

By this arrangement, as the entrapped rotating hot gases rise through each spin chamber 41, they are forced into an ever decreasing annulus, which causes angular acceleration of the gases and increases the spinning thus creating a vortex flow. This vortex flow then acts as a centrifuge and improves the heat transfer by keeping the lighter, hotter gas on the inside of the vortex next to the heat transfer surface 42 of the highly conductive aluminum bowl casting 40, while the heavier, cooler gas moves toward the outer wall provided by the restraining conical segment 44. Additionally, the vortex flow gives the "dwell time" and the "multiple passes" that serves to maximize the amount of heat given up by the hot gases as they pass through this part of each heat exchanger 40R,40L.

Figure 6:
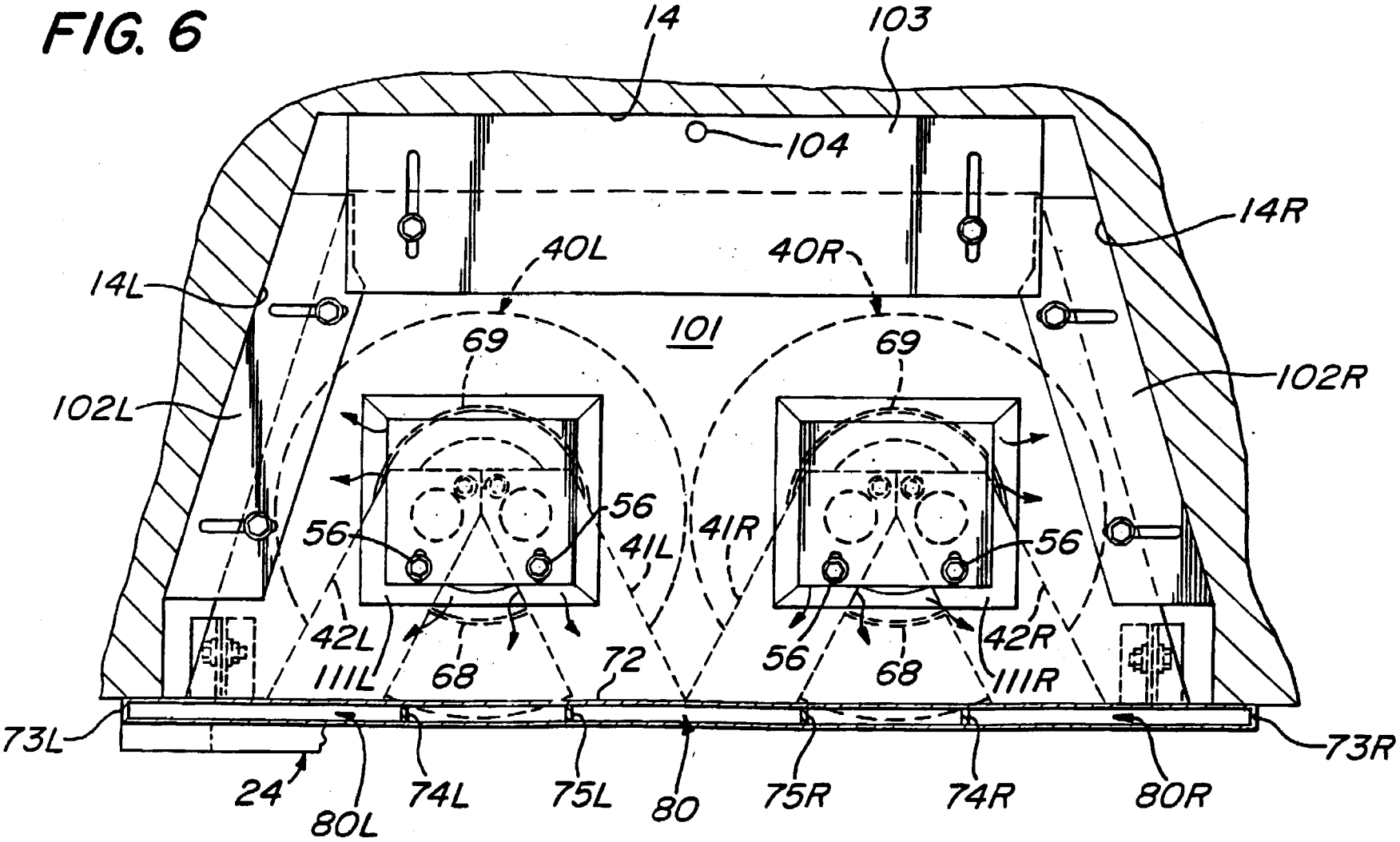
FIG. 6 is a sectional view taken on line 6—6 of FIG. 1.
Figure 7:
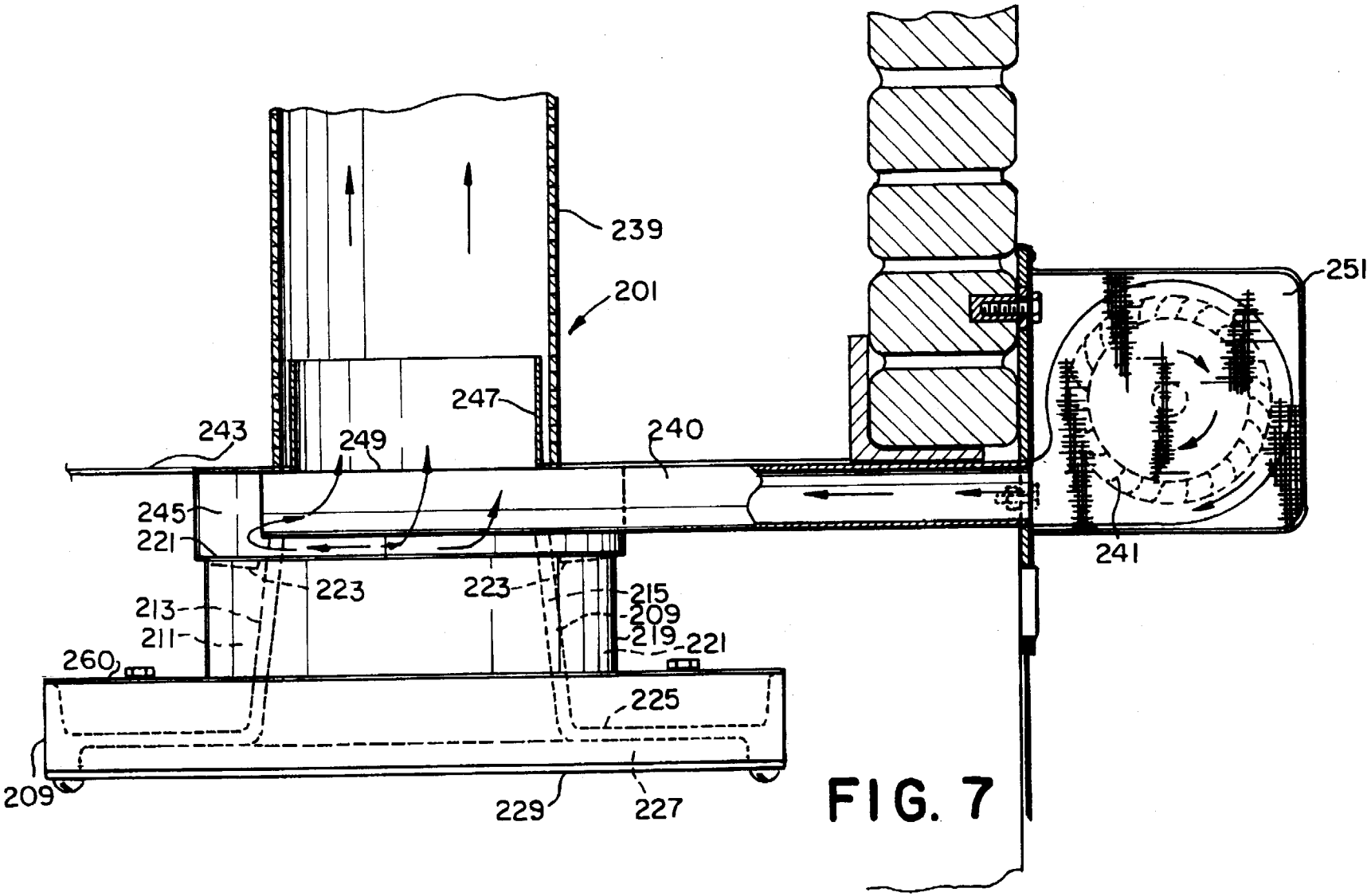
FIG. 7 is a view partly in elevation and partly in section. It shows my second preferred embodiment of the invention.
Figure 8:
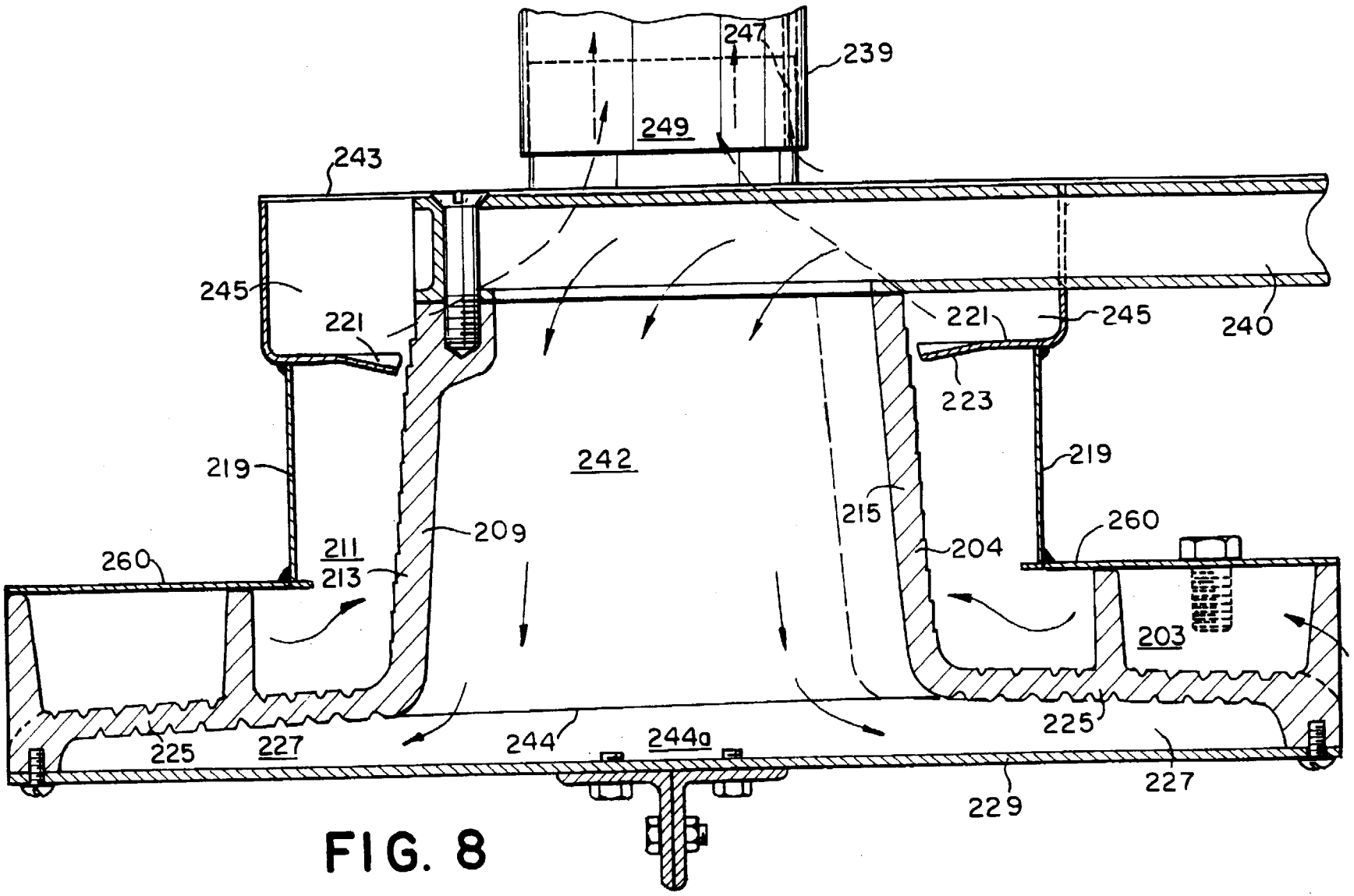
FIG. 8 is a view in vertical section which shows the fireplace heat exchanger assembly of the second preferred embodiment.

There are provided two vertically extending seal strips 68 and 69 shaped in the form of circumferential arcs, these strips 68 and 69 being spot welded immediately adjacent to the opening at the top of each conical segment 44. As best shown in FIGS. 4–6, strips 68 and 69 will occupy a circumferential space between the extrusions 41R,42R and 41L,42L and their associated bowl casting 40 to thereby prevent the combustion gases from going directly from the chamber 10 to the chimney flue 18 and bypassing the heat exchangers 40R and 40L.

After leaving the top of a spin chamber 41 of each heat exchanger 40R,40L, the hot combustion gases will impinge upon the extrusions 41R,42R,41L,42L, which are highly conductive, and the hot gases are guided into additional close contact therewith by louvered openings in the baffle plate assembly 31 immediately above the extrusions. By this arrangement, the extrusions 41R,42R,41L,41L, which provide conduits for the room air, will extract even more thermal energy from the hot gases before these gases finally enter the chimney flue 18.

The aluminum extrusions 41R,42R and other aluminum parts of the heat exchangers 40R,40L are anodized flat black. This improves the heat transfer properties of these parts by improving the heat transfer coefficient thereof.

In accordance with the invention, there is provided a novel fan/duct housing assembly 32 comprising a housing 33 as best shown in FIGS. 3 and 5. This housing 33 is a combination circulating fan housing and room air duct and is provided to house and mount the fan 70, as well as to contain the required passages to bring room air to the fan 70, to take it from the fan 70 to the heat exchangers 40R,40L and to take the heated air from the heat exchangers 40R,40L to distribute it back into the room. It will be noted that in some applications it may be desirable to discharge the heated room air directly into the return duct of a central heating system.

As shown in the drawings, the housing 33 is made up of a formed sheet metal cover 71, a flat sheet metal back 72, a pair of end cover plates 73R,73L, a pair of divider plates 74R,74L and a pair of fan end plates 75R,75L, all of these parts being spot welded together. The housing 33 is mounted adjacent to the heat exchanger subassembly 30 and is positioned on the face of the fireplace and over the top of fireplace opening 12 (much like a secondary fireplace mantel) and extends across the width of the heat exchanger subassembly 30.

As shown in FIG. 1, the glass screen assembly 24 is mounted to extend across the front opening 12 and to be spaced apart a short distance from the front face of the fireplace to provide space for an extended portion 76 of the housing 33 that projects down from the upper rounded part thereof to about one inch below the top of the fireplace opening 12, as best shown in FIGS. 1 and 5. The extended portion 76 is used for the flow of room air into and out of the outer ends of extrusions 41R,42R,41L,42L which communicate with heat exchangers 40R,40L at their inner ends as will be described hereafter.

In order to stabilize the glass screen assembly 24 in its position in front of fireplace opening 12, mounting straps may be supplied to secure the screen assembly 24 in a manner as is conventional in the art. These mounting straps are positioned to straddle the extended portion 76 of the fan/duct housing 33 with each of the straps being attached to an anchoring device which, in turn, is secured to the steel lintel over the fireplace opening. Fireplace screens of this type are conventionally stabilized in this manner by one or two of these mounting strap devices. It may be desirable to further stabilize the heat exchanger assembly by attaching the outer extrusions 42R and 42L to the afore-mentioned mounting straps with angled clips.

A pair of end strips 77R and 77L are provided to seal off the space between the vertical edges of the glass screen assembly and the front face of the fireplace, such strips being made of contact adhesive backed light gauge steel.

Alternatively, the space between the sides of the screen assembly 24 and the brick face of the fireplace can be filled by attaching sealing strips to the screen assembly's frame, these sealing strips being cut from a strip of black anodized aluminum (such as, for example, 0.050–0.055 inches by 1¾ inches) coated on one side with self-sticking adhesive which will adhere the seal strips to the screen assembly's frame. These seal strips will be further stabilized in place with a silicon rubber sealer fillet at the brick facing. This is normally good practice around a glass screen assembly to minimize room air leakage up the chimney in winter time, and especially if the flue damper is left open.

The lower portion of back plate 72 that provides part of the extended portion 76 of the housing 33 has three openings 78R,78L, and 79 therein. The two outer openings 78R and 78L connect with the open outer end of extrusions 42R and 42L, respectively. The larger center opening 79 straddles and connects with the open outer end of extrusions 41R and 41L. The two vertically extending divider plates 74R and 74L divide the interior of housing 33 into two outlet chambers 80R and 80L and a centrally located inlet chamber 80 for the room air. A pair of louvered openings 82R and 82L in the bottom portion of cover 71 connect inlet chamber 80 and the room, to thereby provide for the flow of air from the room into inlet chamber 80 during operation of fan 70. Openings 82R and 82L are located to direct air into the space between plates 74R and 75R and between 74L and 75L, respectively, so that the air flow is confined to flow into the central intake of the fan 70. A pair of louvered openings 84R and 84L connect outlet chambers 80R and 8OL, respectively, and the room to provide for the flow of heated room air from outlet chambers 80R and 80L, respectively, back into the room during operation of the fan 70.

The fan 70 is of the squirrel cage type and is mounted, preferably by a rubber mounting for noise prevention, inside the inlet chamber 80 of fan/duct housing 33. The fan 70 consists of a centrifugal fan impeller (typically 3½ inch diameter by 5 inch long) with its integral fractional (typically 1/10 ) horsepower electric motor 70M and a discharge scroll 70S. The fan 70 is mounted eccentrically in its housing 33 to form discharge scroll 70S as shown in FIG. 5. The discharge scroll 70S of the fan 70 is separated from the rest of the inlet chamber 80 by the two plates 75R and 75L which are constructed and arranged as side extensions welded to the sides of the discharge scroll 70S and extending down into the vertically extending portion 76 in an arrangement to straddle the opening 79. Opening 79 is arranged to connect with the outer ends of extrusions 41R and 41L which deliver room air to the heat exchangers 40R and 40L, respectively. By this arrangement, the incoming room air is directed into the center opening at each end of scroll 70S of fan 70 and is discharged therefrom to flow downwardly to opening 79.

Means are provided to mount the fan/duct housing subassembly 32 conveniently to the previously erected heat exchanger and baffle plate subassemblies 30 and 31. Such means comprises two heavy duty steel strap angled mounting brackets 86R and 86L, which are secured to the outside of back plate 72 by welding. A corresponding pair of angled mounting brackets 88R and 88L are secured, by welding onto a part (i.e., main baffle plate 101) of the baffle plate assembly 31. Brackets 86R,86L and 88R,88L are provided with horizontal slots in vertical legs thereof, which slots are arranged to receive bolts for securing overlapping brackets 86R,86L and 88R,88L together in a manner well known in the art.

In order to carry the cantilevered weight of the fan/duct housing 33, the outer extrusions 42R and 42L are further supported by a short tubular column 87 between them and the bowl castings 40, as is best shown in FIG. 5. This tubular column 87 is held in position by roll pins 89 at its top and bottom. The lower roll pin 89 is driven into a hole into the top of one of the guide vanes 46 at the outer periphery of the casting 40.

By this arrangement, after the heat exchanger subassembly 30, with its fitted baffle assembly 31 attached, has been positioned on its goal post support in the fireplace (in a manner to be described hereafter), the fan/duct housing 33 can be readily attached and firmly supported. The power cord of the electric motor 70M of fan 70 is preferably arranged to run through the fan/duct housing 33 and along the top mantel portion to the thermostat for the gas log burner 20 and the power source.

Means are provided for positioning the heat exchanger subassembly 30 to be located at the most advantageous position, namely, immediately over the fire but high enough so as to not interfere with the view or esthetics of the flame produced by the gas log burner 20. To this end, a goal post shaped adjustable support assembly 34 is provided to hold and support all of the subassemblies 30, 31, and 33 in their proper elevated positions.

The goal post support assembly 34 consists of seven members made of high temperature steel and provided with perforated slots in a side thereof so that two associated members can be interconnected adjustably, whereby the width and the height of the goal post support assembly 34 can be adjusted. Thus, the goal post support assembly 34 comprises a pair of upright legs 90R and 90L, each of which consists of a pair of angle members bolted together to provide the proper height for the support assembly 34 so that the top of the heat exchanger assembly 30 and the associated main baffle of the baffle assembly 31 will always be level with the top of the fireplace's front opening 12. Support assembly 34 also comprises a horizontal support including a center crossbar member 91 and two crossbar extension members 91R and 91L, each of which is adjustably bolted to an end of the center member 91. The center crossbar member 91 is secured, by bolts 93R,93L, on the underside of each of the heat exchangers 40R and 40L of the heat exchanger subassembly 30 and the two crossbar extension members 91R and 91L are fitted to the ends of the center crossbar member 91 to provide the proper width to fit the fireplace chamber at this location. The ends of the extension members 91R,91L are joined by means of bolts to the upper ends of the two upright legs 90R and 90L, respectively, to provide the goal post type of support arrangement for the entire structure.

It will be noted that the center crossbar member 91 is located between the front face of the fireplace and the center of gravity of the assembly 30 of the two heat ex-changers 40R,40L (and their associated extrusions 41R,42R, 41L, 42L) and the associated baffle plate assembly 31. With the horizontally extending center crossbar 91 at this location, the entire assembly of parts, after the attachment of the fan/duct housing subassembly 32, will be held in place in a secure manner, as will be apparent from the drawings, since the forward portion of the assembly of parts will be urged upwardly against the angle iron member forming the top horizontally extending opening 12 of the fireplace. Thus, as viewed in FIG. 1, with the horizontal crossbar member 91 located to the right of the center gravity of the assembled parts, the forward portion of the assembly of parts will tend to move upwardly whereas the rearward portion of the assembly of parts to the left of the cross-bar will tend to move downwardly. However, since the forward part of this assembly of parts is prevented from moving upwardly by reason of its contact with the angle member providing the top of the fireplace opening 12, the assembly of parts will be held securely in place.

Means are provided for sealing off the top of the fire chamber from the chimney flue in order to ensure that the upwardly flowing combustion gases are caused to flow through the heat exchangers 40R,40L as they flow from the combustion chamber 10 to the chimney flue 18. Such means comprises the adjustable baffle plate assembly 31, which is provided with only two openings which are located to ensure the desired flow of hot gases. As discussed above, it is assumed that the original fireplace dampener has been left open or removed entirely when the fireplace is provided with a heating system in accordance with the invention.

The baffle plate assembly 31 consists of four steel sheets (typically 0,035–0.040 inches thick) which are provided with slots and are constructed and arranged to be slideably adjustable relative to one another so that the baffle plate assembly 31 may be readily fitted into a wide range of fireplace sizes and shapes. As may be seen in FIG. 3, the assembly 31 consists of a main baffle plate 101, two baffle plate end extensions 102R,102L, and an adjustable damper strip 103 extending across the back portion of the assembly 31.

As is apparent from the drawings, the width and shape of the baffle plate assembly 31 can be made to conform to the fireplace by adjusting the position of the end extensions 102R and 102L relative to main baffle plate 101, and then permanently adjusting or fitting the assembly from inside the fireplace. The damper strip 103 can be permanently set or variably adjusted relative to main baffle plate 101 to fit the depth of the fireplace. If the heating system of the invention is to be used in a wood burning fireplace, the variable adjustment of the damper strip 103 can be used to provide a "dampener position" for more rapid smoke evacuation while starting the wood fire. To this end, a hole 104 is provided in adjustable damper strip 103 for engagement with a fireplace poker. In this case, when the damper strip 103 has been adjusted to the closed position, the bypass gas flow is eliminated and all of the hot gases are drawn through the heat exchangers 40R and 40L on their way to the chimney flue 18.

The end extensions 102R,102L and damper strip 103 are set in various adjusted positions relative to main baffle plate 101 by the use of a special screw-type of connector 105 best shown in FIG. 5. The special construction is provided with a screw 105 which is provided with flats 106 on its shank so that it can be held from inside the fireplace while an engaged nut 107 is tightened after the plate has been properly fitted to the desired position. Thus, each baffle plate assembly 31 can be readily conformed, in place, to the fire chamber's top opening. As will be seen from the drawings, once the baffle plate assembly 31 has been fitted to the fireplace, it can then be adjustably mounted to the heat exchanger subassembly 30 by the use of the heavy duty, hexagonal head drive screw assemblies 56. The drive screw assemblies 56 are constructed and arranged to screw into the extrusions by using washers and adjustment slots in the main baffle plate 101. In this way, the baffle plate assembly 31 can be selectively positioned relative to the heat exchanger assembly 30 to allow for variations in thickness of the front wall over the fireplace opening 12.

Main baffle plate 101 is provided with two louvered openings 111R and 111L having a right angular shape. Openings 111R and 111L overlie the annular openings at the top of the spin chambers 41 of heat exchangers 40R and 40L, respectively. Openings 111R and 111L are constructed and arranged to guide the hot gases exiting the spin chamber 41 into contact with the extrusions 41R,42R,41L,42L so that the room air flowing therethrough will extract even more thermal energy from the hot combustion gases before they finally enter the chimney flue 18.

It will be apparent that there is provided a novel assembly and support arrangement of the various components and subassemblies as is described in detail above. Thus, the two heat exchangers 40R and 40L are assembled together with the four extrusions 41R,42R,41L,42L in a unique manner by means of the screw assemblies 56,56' and the support arrangement including the roll pins 89 and tubes 87. The baffle assembly 31 is a subassembly of four parts and is supported on the assembly 30 by means of the mounting screws 56 as described in detail above. The fan/duct housing subassembly 32 is assembled to the subassembly 31 by means of the cooperating mounting brackets 86R,86L and 88R,88L. Also, the three subassemblies 30, 31, and 32, which are assembled together, are, as a unit, supported by means of the goal post support assembly 34 so that all of the subassemblies are secured together in a stable structure within the fireplace.

In the use of the fireplace heating system in accordance with the invention, a fire burning in the combustion chamber 10 by the operation of the burner 20 draws cold air into combustion chamber 10 by way of the outside air passage including vent 11, conduit 13, and opening 15. The air flows upwardly through opening 15 into combustion chamber 10 to provide the oxygen for supporting the combustion of the burner gases. The fire screen assembly 12 prevents room air from passing into the combustion chamber 10 so that the outside air is the sole source of oxygen for the burning fire. This provides considerable energy savings since the use of room air to support the combustion would require subsequent reheating of the room air by the heating system of the home.

In addition, the room air is heated by the action of the heat exchangers 40R and 40L by the operation of the fan 70 to circulate room air through the heat exchange passages as described above. Briefly, the hot combustion gases flow upwardly through the spin chambers 41 of the heat exchangers 40R and 40L to heat up the walls of the aluminum casting 40. At the same time, room air is circulated through the heat exchanger chamber 52 in heat exchange relationship with the hot combustion gases whereby the temperature of the room air is elevated as it passes through the heat exchangers 40R and 40L. This heated room air is circulated back into the room through the fan/duct housing 33 as described above. Briefly, the circulating room air flow produced by the operation of the fan 70 is as follows:

The air is drawn into the inlet chamber 80 by way of the louvered openings 82R,82L and is drawn into the center portion of the squirrel cage fan 70 which causes the air to circulate around the discharge scroll 70S and be delivered downwardly through the downwardly extended portion of chamber 80 between plates 75R and 75L to opening 79 and into the outer ends of the two extrusions 41R and 41L. The room air then flows through the extrusions 41R and 41L to the inner ends thereof and passes downwardly through openings 51R and 51L into the inner half of the chamber 52 of heat exchangers 40R and 40L. The room air then flows downwardly through the inner half of chamber 52, through opening 59 and upwardly through the outer half of chamber 52 to thereby pass through openings 62R and 62L in castings 40 and the openings 52R and 52L at the inner end of extrusions 42R and 42L. The room air then passes through the extrusions 42R,42L into the chambers 80R and 80L by way of openings 78R and 78L, respectively, and exits these chambers by way of the louvered openings 84R,84L to flow back into the room in a heated condition.

The second preferred embodiment of my heat exchanger assembly 201 is shown in FIGS. 7 through 14 and it directs the exhaust gases from the fire into channels 203 which have entrances at the four corners 205–208 of the heat exchanger casting 209, and directs those gases tangentially and radially inwardly, to give the same rotation as Coriolis forces, i.e., counterclockwise when viewed from above in the Northern Hemisphere. The exhaust gases are drawn by chimney draft into the spin chamber 211, which is an annular chamber formed between the outer wall 213 of the cast aluminum vertical cylindrical shaped bowl portion 215 of the heat exchanger casting 209, and the inner face of the surrounding wall of a sheet steel retaining cylinder 219. A vaned sheet steel disc 221 is positioned horizontally and is welded near the top of the steel cylinder 219 to further retain the exhaust gases in the spin chamber 211, and increase the dwell time in spin chamber 211. The vanes 223 of the disc 221 further encourage the spin effect as the hot gases exit the annular shaped spin chamber 211.

Figure 12:
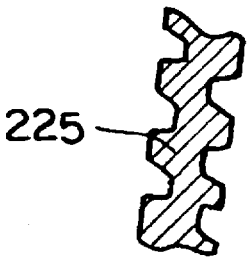
FIG. 12 is a view in section of that portion of the heat exchanger casting which is identified by the number 12 in FIG. 10.
Figure 13:
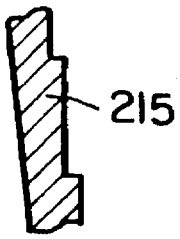
FIG. 13 is a view in section of a portion of the heat exchanger of the invention identified by the number 13 in FIG. 10.

To increase the efficiency of the heat transfer from heat exchanger bowl portion 215, the bowl portion 215 is stepped as shown in FIG. 13 and the brim portion 225 is corrugated as shown in FIG. 12.

In addition to the heat exchanging surface on the cylindrical bowl portion 215 of the heat exchanger casting 209, there are other areas where heat transfer takes place.

If you consider the heat exchanger casting 209 as being hat shaped, with a bowl portion 215 and a turned down square shaped brim portion 225, a ⅛" flat bottom plate 229 screws up into the brim portion 225 forming a thin wide bottom chamber 227, about 10" square by ⅜" high, which has the room air circulating through it. Plate 229 is of black, anodized aluminum. Radiation from the flames and glowing logs and coals heats the underside of this plate 229 which then conducts the heat to the room air circulating above it.

Inside the bowl portion 215, there is a room air chamber 242 with an inlet portion 242a separated from an outlet portion **242*b* by a divider plate 244 with a bottom slot 244*a* for passing air from inlet portion 242*a* to outlet portion 242*b***.

Figure 9A:
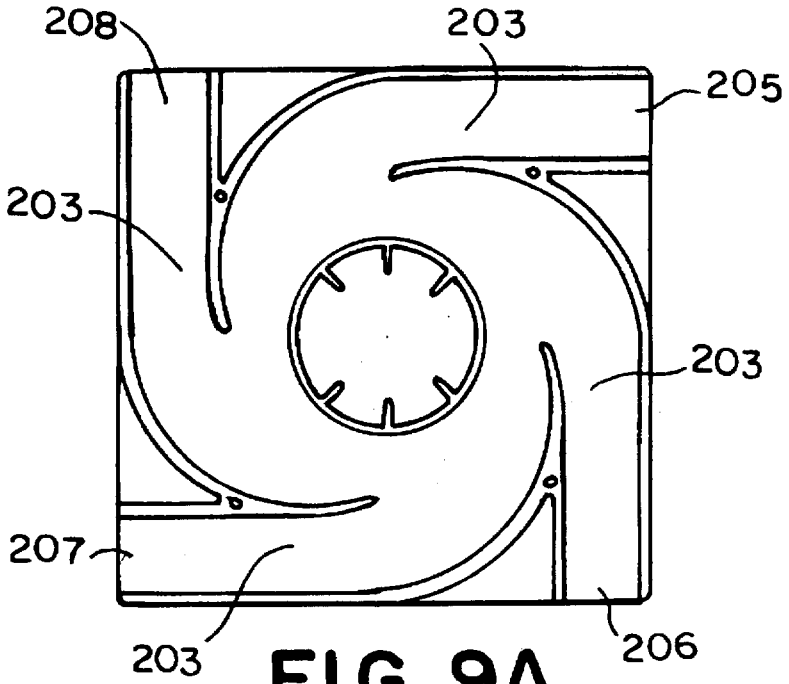
FIG. 9A is a view in top plan of the combustion gas passages of the invention.
Figure 9:
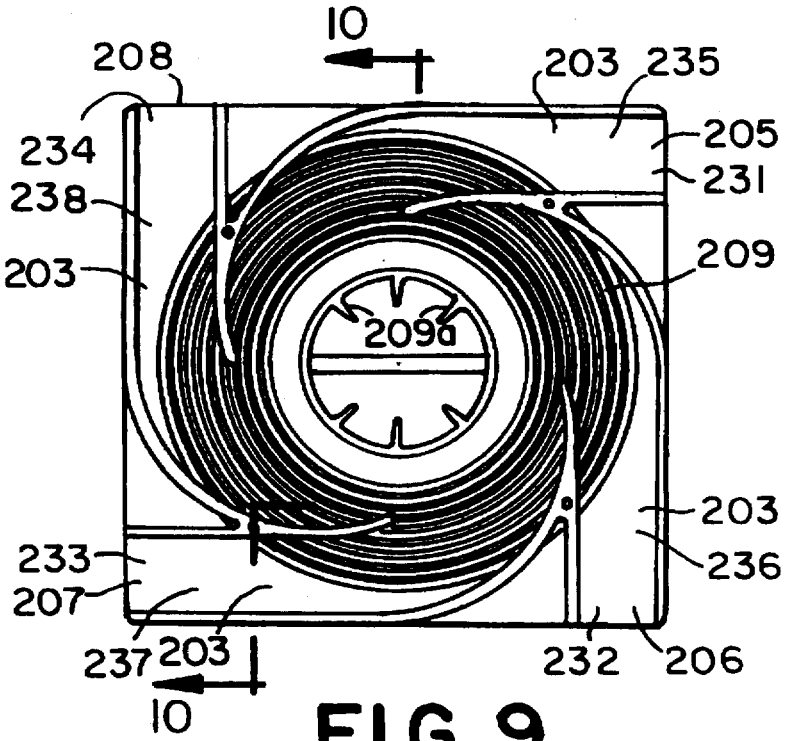
FIG. 9 is a view in top plan of the heat exchanger casting of the invention.
Figure 10:
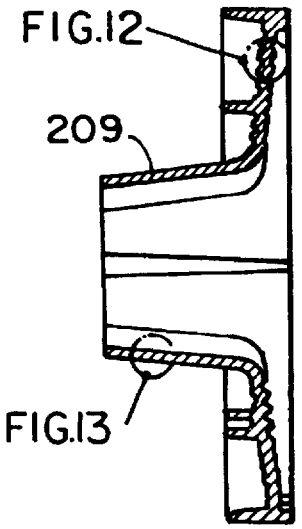
FIG. 10 is a view in section taken as indicated by lines and arrows 10—10 which appear in FIG. 9.
Figure 11:
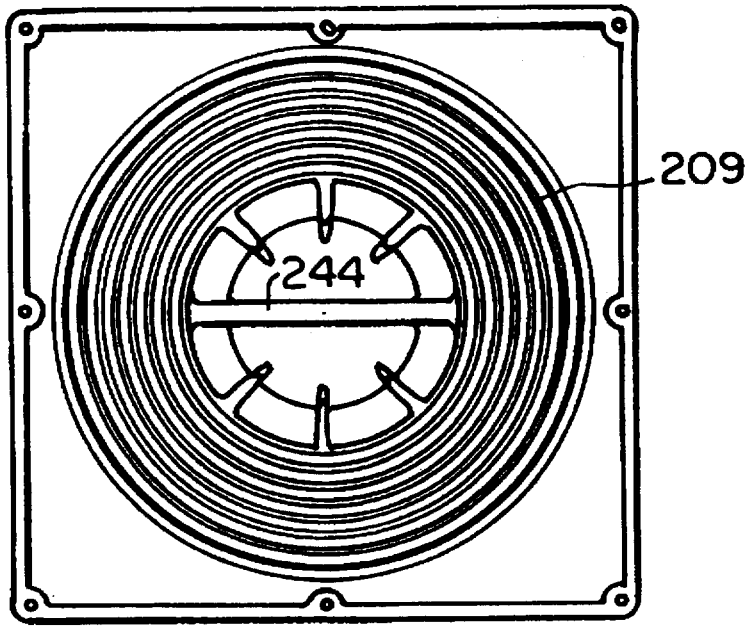
FIG. 11 is a view in bottom plan of the second embodiment of the invention.
Figure 14:
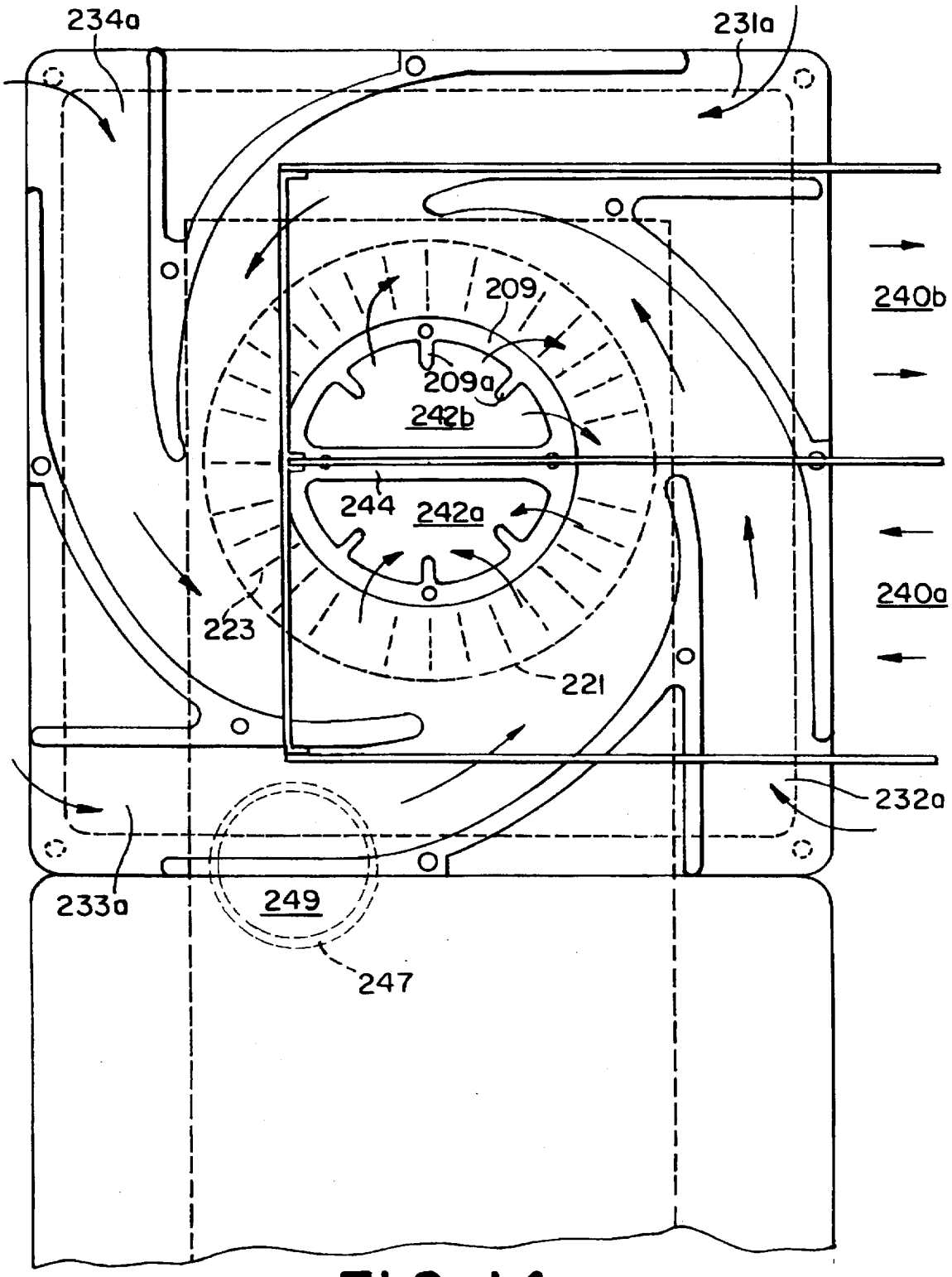
FIG. 14 is a view in horizontal section of the second preferred embodiment of the invention.

Hot exhaust gases are drafted into the four entrances 231–234 of FIG. 9, and **231*a*–234*a* of FIG. 14, of the channels 203 at the corners 205–208 of the two heat exchangers. The hot exhaust gases are then carried through four inwardly spiral shaped passageways 235–238 where their velocity is accelerated. The black anodized aluminum surfaces of these cast passageways 235–238 pick up heat from the hot gases and transfer the heat into the room air circulating in the bottom chamber 227 under-neath the brim 225 of the heat exchanger 209. The gases exit these channels or passageways 235–238 and enter the spin chamber 211 tangentially at relatively high velocity which encourages good heat transfer to the room air in chamber 242**.

Extruded tubes 240, which are black anodized aluminum rectangular in cross-section, preferably 1" high ×4" wide, are provided to carry the room air from the twin air circulating centrifugal fan rotors 241 into and out of the heat exchangers 209. These room air tubes 240 pick up heat as they pass through the firebox, but pick up even more heat when a high velocity exhaust gas impinges on them as the exhaust gas exits the two vaned discs 221 at the top of the spin chambers 211.

All of this heat transfer is accomplished in a relatively compact space with a heat exchanger assembly 201 that is adjustably and readily installable and conformable to an existing masonry fireplace.

Another improvement in this embodiment 201 of my invention is provided by employing a 4 inch flexible metal tube 239 inside the masonry chimney and attaching it to a covered and screened plate at the top of the chimney and to the main baffle sheet 243 at the top of the fire chamber. The advantage of this arrangement is to prevent downdrafts, provide a chimney that warms quickly, prevent the entry of squirrels and birds into the chimney, and provide a tighter exhaust passage for better draft.

To this end, and to provide a tighter sealing arrangement for the exhaust gases leaving the heat exchanger assembly 201, a welded sheet steel, exhaust gas, exit chamber 245 is provided with an open top which is closed off by the main baffle plate 243 after installation of the heat exchanger assembly 201 in the fireplace. This chamber 245 is an integral part of a welded steel sub-assembly which includes two sheet steel top plates 260 that bolt onto the two heat exchangers 209, and the two sheet steel spin chamber cylinders 219 with their vaned exit discs 221 which are stamped into the bottom of exit chamber 245. This sub-assembly then rigidly holds the two heat exchanger castings 209 in their proper spacial relationship. The welded sheet steel exhaust gas exit chamber 245 provides a passageway for the exhaust gases leaving each heat exchanger 209 to come together for their common exit connection to the 4" flexible tube 239 in the chimney. This tube 239 surrounds a 3¾"×1" high tubular stub 247 around the exit hole 249 in the main baffle plate 243 and is welded to the main baffle plate 243.

The following is the assembly procedure of the heat exchanger assembly:

The square aluminum bottom plates 229 are screwed to the bottom of the two heat exchanger castings 209 using eight self tapping screws each and a high temperature gasket or silicone caulk on the flanges to seal in the room air and seal out the hot combustion gases.

The welded sheet steel open top exhaust chamber 245, with two cover discs 221 and integrated spin chamber cylinders 219 are then bolted to the two heat exchanger castings 209 using four 5/16" cap screws on each cover.

The four extruded rectangular tubes 240 are then bolted to the heat exchanger castings 209, once again using a gasket or silicone caulking for better sealing. The result of this assembly procedure is to produce a heat exchanger sub-assembly unit ready for installation at the top of the fire-chamber or box.

The dual fan/motor assembly 251 is then attached to a flat sheet steel or brass fireplace header trim panel.

The following is the installation procedure: The proper length of flexible chimney liner tubing 239, with a couple inches of surplus, is attached to the covered chimney cap and dropped down the chimney, after removal of the fireplace damper, and the cap is secured to the top of the masonry chimney.

The heat exchanger assembly 201 is then installed so that its top surfaces are flush with and press up against the main baffle plate 243. Also, it must be ascertained that the opening in the chimney is aligned inside the exhaust chamber 245. Additionally, the ends of the four extruded room air tubes 240 are positioned so as to be flush with the masonry face of the fireplace so that they press out against the header trimplate. The heat exchanger assembly 201 is adjustably attached to the goal post verticals as previously described.

The bottom end of this tube 239 is placed over the stub 247 on the main baffle plate 243 and the baffle plate 243 is placed at the top of the firebox and held there by a pair of angle clips attached to the goal post support vertical angles. The main baffle is either cut down to size or is provided with sealing strips installed around its edges as previously described.

The header trimplate, with its fan attached, is secured to the masonry fireplace face with proper number and size of lag screws. The properly fitting glass doors are then installed.

In operation, the fan/motor assembly 251 draws air from the room and sends it through room air tubes 240 into the inlet portion **242*a* of room air chamber 242. The room air enters room air chamber 242 through inlet portion 242*a* and moves downwardly while absorbing heat from the combustion gases spinning around the heat exchanger 209. The room air then moves under the divider plate 244 and into the outlet portion 242*b* of the room air chamber 242, where it continues to absorb heat from the combustion gases spinning around the heat exchanger 209. Then the room air exits the room air chamber 242 through an outlet room air tube 240** and is delivered back to the room or to another portion of the heating system.

The heat exchange passages for the combustion gases include four tangential channels 203 each having an entrance at a corner 205–208 of the heat exchanger assembly 201 and having an exit which is tangential to the outer surface of the heat exchanger bowl portion 215 so as to direct the combustion gases in a circular direction around the heat exchanger bowl 215. The combustion gases spin around in the spin chamber 211, and the heat exchanger casting 209 transfers heat from the combustion gases to the room air passing through and dwelling in the room air chamber 252 including inlet portions **242*a* and outlet portions 242*b***.

The combustion gases, as they spiral upwardly, pass out of the chimney through the exhaust gas exit chamber 245 and the flue of the chimney through stub 247 and exit tube 239 in the chimney.

It will be apparent that various changes can be made in the construction and arrangement of parts without departing from the scope of the invention.

What is claimed is:

1. For use with a fireplace comprising a combustion chamber having a front opening and a back wall, a chimney flue connected to a top portion of the combustion chamber for discharging combustion gases therefrom, a hearth, heating means supported at the bottom of the combustion chamber for providing heating gases in response to combustion, and a fire screen assembly or the like for closing off the front opening of the fireplace, the combination comprising a heat exchanger assembly including a heat exchanger, means for mounting said heat exchanger at the top portion of the combustion chamber to extend horizontally across the location where the chimney flue connects with the top portion of the combustion chamber, said heat exchanger comprising means defining a first heat exchange passage for the flow of room air across an upper portion of the combustion chamber, means defining a second heat exchange passage for the flow of combustion gases vertically up from said combustion chamber to the fireplace flue, said first and second heat exchange passages being in heat exchange relationship so that the hot combustion gases passing through said second heat exchange passage heat up the room air flowing through said first heat exchange passage, said second heat exchange passage being constructed and arranged to induce a vortex flow of the combustion gases about a vertical axis, and having a generally annular configuration encircling said first heat exchange chamber.

2. For use with a fireplace comprising a combustion chamber having a front opening and a back wall, a chimney flue connected to a top portion of the combustion chamber for discharging combustion gases therefrom, a hearth, heating means supported at the bottom of the combustion chamber for providing heating gases in response to combustion, and a fire screen assembly or the like for closing off the front opening of the fireplace, the combination comprising a heat exchanger assembly including a heat exchanger, means for mounting said heat exchanger at the top portion of the combustion chamber to extend horizontally across the location where the chimney flue connects with the top portion of the combustion chamber, said heat exchanger comprising means defining a first heat exchange room air passage for the flow of room air across an upper portion of the combustion chamber and into and out of a room air chamber in the heat exchanger, means defining a second heat exchange combustion gas annular spin passage for the flow of combustion gases vertically up from said combustion chamber to the fireplace flue, said first and second heat exchange passages being in heat exchange relationship so that the hot combustion gases passing through said second heat exchange passage heat up the room air flowing through said first heat exchange passage, said second heat exchange spin passage being constructed and arranged to induce a flow of the combustion gases about a vertical axis and having a generally annular configuration encircling said first heat exchange room air chamber, a divider plate mounted in the room air chamber dividing the room air chamber into an inlet portion and an outlet portion, and means directing the room air downwardly into the room air chamber inlet portion and then upwardly through the room air chamber outlet portion and out of the heat exchanger.

3. The heat exchanger assembly of claim 2, said heat exchanger having a bowl portion and a brim portion extending from the bottom of the bowl portion, said second heat exchange passage for combustion gases including four tangential channels each having an entrance at a corner of the heat exchanger and having an exit which is tangential to the outer surface of the heat exchanger bowl portion so as to direct the combustion gases into a circular direction around the heat exchanger bowl.

4. For use with a fireplace comprising a combustion chamber having a front opening and a back wall, a chimney flue connected to a top portion of the combustion chamber for discharging combustion gases therefrom, a hearth, heating means supported at the bottom of the combustion chamber for providing heating gases in response to combustion, and a fire screen assembly or the like for closing off the front opening of the fireplace, the combination comprising a heat exchanger assembly (201) including a heat exchanger (209), means for mounting said heat exchanger at the top portion of the combustion chamber to extend horizontally across the location where the chimney flue connects with the top portion of the combustion chamber, said heat exchanger (209) comprising a heat exchanger (209) with a bowl portion (215) connected to a bottom brim portion (225), a spin chamber (211) surrounding the outside of the heat exchanger bowl portion (215) for spinning hot combustion gases around the bowl portion (215) to transfer heat to the bowl portion (215), a room air chamber (242) in the heat exchanger bowl portion (215) with an inlet portion (**242*a*) for receiving cold room air and an outlet portion (242*b*) for receiving heated air from the inlet portion (242*a*) and further heating it, a divider plate (244) in the room air chamber (242) which separates said inlet and outlet portions, a room air intake fan forcing room air from the room into the inlet portion (242*a*) of the room air chamber (242), and room air passages connecting the fan to the inlet portion (242*a*) of the room air chamber (242) and connecting the outlet portion (242*b*) of the room air chamber (242**) to the room.

5. The heat exchanger of claim 4, said room air chamber (242) having a bottom plate (229) connected to the brim portion (225) of the heat exchanger (209).

6. A method of heating room air in a fireplace having a combustion chamber with a front opening and a back wall, a chimney flue connected to a top portion of the combustion chamber for discharging combustion gases therefrom, a hearth, heating means supported at the bottom of the combustion chamber for providing heating gases in response to combustion, and a fire screen assembly or the like for closing off the front opening of the fireplace, the method comprising positioning a heat exchanger in the top portion of the fireplace between the heating means and the flue, mounting a heat exchanger at the top portion of the combustion chamber to extend horizontally across the location where the chimney flue connects with the top portion of the combustion chamber, circulating a flow of room air across an upper portion of the combustion chamber and into and out of a room air chamber in the heat exchanger to heat the room air, directing the room air downwardly into a room air chamber inlet portion and then upwardly through a room air chamber outlet portion and out of the heat exchanger, circulating a flow of hot combustion gases vertically up from said combustion chamber to the fireplace flue, spinning the hot combustion gases around a vertical axis and in a generally annular configuration encircling the outside of the room air chamber of the heat exchanger to heat the room air chamber and the room air inside the room air chamber, and heating the room air in the room air chamber which is heated by the hot combustion gases which spin around outside the room air chamber.

7. The method of claim 6, including directing the heated room air out of the fireplace and into the room.

8. For use with a fireplace comprising a combustion chamber having a front opening and a back wall, a chimney flue connected to a top portion of the combustion chamber for discharging combustion gases therefrom, a hearth, heating means supported at the bottom of the combustion chamber for providing heating gases in response to combustion, and a fire screen assembly or the like for closing off the front opening of the fireplace, the combination comprising a heat exchanger assembly (201) including a heat exchanger (209), means for mounting said heat exchanger at the top portion of the combustion chamber to extend horizontally across the location where the chimney flue connects with the top portion of the combustion chamber, said heat exchanger (209) comprising a heat exchange room air passage for the flow of room air across an upper portion of the combustion chamber and into and out of a room air chamber (242) in the heat exchanger (209), a heat exchange combustion-gas annular spin chamber (211) for the flow of combustion gases around the outside of the room air chamber (242) to transfer heat to the room air in the room air chamber (242), said heat exchanger room air chamber (242) and the heat exchange combustion gas annular spin chamber (211) being in heat exchange relationship so that the hot combustion gases passing through said heat exchange combustion gas annular spin chamber (211) heat up the room air flowing through said room air chamber (242), said heat exchange combustion gas spin chamber (211) being constructed and arranged to induce a flow of the combustion gases about a vertical axis and having a generally annular configuration encircling said heat exchange room air chamber (242), a divider plate (244) mounted in the room air chamber (242) dividing the room air chamber (242) into an inlet portion (242*a*) and an outlet portion (242*b*), means directing the room air downwardly into the room air chamber inlet portion (242*a*) and then upwardly through the room air chamber outlet portion (242*b*) and out of the heat exchanger, means directing the combustion gases into the annular spin chamber (211), and means directing the combustion gases from the annular spin chamber (211) to the fireplace flue.

* * * * *